US009526355B1

(12) United States Patent
Rollins et al.

(10) Patent No.: US 9,526,355 B1
(45) Date of Patent: Dec. 27, 2016

(54) SHELF STRUCTURE

(71) Applicant: Nashville Wire Products Mfg. Co., Nashville, TN (US)

(72) Inventors: Robert N. Rollins, Nashville, TN (US); Phillip Kent Rollins, Nashville, TN (US)

(73) Assignee: Nashville Wire Products Mfg. Co., Nashville, TN (US)

( * ) Notice: Subject to any disclaimer, the term of this patent is extended or adjusted under 35 U.S.C. 154(b) by 254 days.

(21) Appl. No.: 14/059,666

(22) Filed: Oct. 22, 2013

(51) Int. Cl.
*A47F 5/00* (2006.01)

(52) U.S. Cl.
CPC ..... *A47F 5/0043* (2013.01)

(58) Field of Classification Search
CPC ..... A47F 5/0068; A47F 5/005; A47F 5/01; A47F 5/13; A47F 5/14; A47F 5/0056; A47F 5/0043; G09F 3/204; G09F 3/20; G09F 3/201; A47B 57/581; A47B 96/021; A47B 96/02
USPC ..... 211/90.03, 119, 134, 153
See application file for complete search history.

(56) References Cited

U.S. PATENT DOCUMENTS 2,599,607 A * 6/1952 Burrise ..... F25D 25/02 211/153
2,730,825 A * 1/1956 Wilds ..... G09F 3/20 211/49.1
3,637,085 A * 1/1972 Ball ..... A47B 96/021 211/153
4,295,288 A * 10/1981 Westberg ..... G09F 3/20 40/651
5,088,607 A * 2/1992 Risafi ..... A47B 57/42 211/187
5,119,945 A * 6/1992 Wiggins ..... A47F 5/0056 211/184
5,255,802 A * 10/1993 Krinke ..... A47F 5/005 211/184
5,607,068 A * 3/1997 Coretti, Jr. ..... A47F 5/135 211/59.2
6,226,910 B1 * 5/2001 Ireland ..... G09F 3/204 40/651
6,390,310 B1 * 5/2002 Insalaco ..... A47B 96/02 211/134
6,889,855 B2 * 5/2005 Nagel ..... A47F 1/126 211/59.3
7,367,149 B2 * 5/2008 Fast ..... G09F 3/16 40/649

(Continued)

OTHER PUBLICATIONS

Exhibit A is a computer generated drawing of the prior art shelf structure shown in Fig. 8 of the application. (dated prior to Oct. 21, 2013).

(Continued)

*Primary Examiner* — Patrick Hawn
(74) *Attorney, Agent, or Firm* — Lucian Wayne Beavers; Patterson Intellectual Property Law PC

(57) ABSTRACT

A welded wire mesh shelf structure is provided for cantilevered racks for warehouse storage. The shelf structure includes a welded wire mesh grid and a nose piece attached to the grid such that a top nose surface is flush with and defines an extension of an upper support plane defined by the wire grid. Fasteners attaching the shelf structure to cantilevered arms are flush with or recessed below the top support plane such that no protruding edge is presented by the nose piece to snag articles sliding on the upper support plane.

10 Claims, 7 Drawing Sheets

(56) References Cited

U.S. PATENT DOCUMENTS

| | | | | |
|---|---|---|---|---|
| 8,443,992 | B2 * | 5/2013 | Lawson | A47B 47/024 211/187 |
| 2003/0189018 | A1 * | 10/2003 | Hopkins | A47F 5/01 211/90.02 |
| 2006/0207950 | A1 * | 9/2006 | Kiehnau | A47F 5/0068 211/59.2 |
| 2006/0243684 | A1 * | 11/2006 | Scharff | G09F 3/204 211/59.4 |
| 2010/0155353 | A1 * | 6/2010 | McAllister | A47B 96/028 211/153 |
| 2014/0116973 | A1 * | 5/2014 | Buckley | A47F 5/00 211/134 |

OTHER PUBLICATIONS

Exhibit B is a photograph of the right front corner of the shelf structure shown in Fig. 8 and Exhibit A. (dated prior to Oct. 21, 2013).

Exhibit C is a photograph of the prior art structure of Fig. 8 and Exhibits A and B and showing a fastener in place to illustrate the snag point created by the fastener as used with the prior art device of Fig. 8 and Exhibits A, B and C. (dated prior to Oct. 21, 2013).

* cited by examiner

SHELF STRUCTURE

BACKGROUND OF THE INVENTION

1. Field of the Invention

A wire shelf construction is disclosed which is particularly suitable for use in an apparel distribution warehouse. The shelf is designed for relatively light loads and is to be installed on cantilever style warehouse racks.

2. Description of the Prior Art

Typical warehouse rack construction for apparel and other relatively light articles utilizes a support frame including extended cantilever support arms. Wire mesh shelves are attached to the cantilevered support arms.

One such prior art shelf structure is schematically illustrated in cross-section view in FIG. 8 and includes a nose piece 100 having an upper flange 102 which extends over the front side of a wire grid 104. The nose piece 100 is welded to the wire grid 104 in a conventional mesh welding machine. A hex head fastener 106 extends down through the upper flange 102 of the nose piece 100 and engages a cantilevered arm 108 to secure the shelf structure to the cantilevered arm 108.

A problem encountered with shelf structures such as the one shown in FIG. 8 is that the rear edge 110 of the nose piece 100 and the head 112 of the fastener 106 extend upward above a top support plane 114 of the grid 104 and thus create snag points for the product which is placed upon the shelves.

Accordingly, there is a need for improved constructions of wire rack structures for use in warehouse shelving.

SUMMARY OF THE INVENTION

In one embodiment a shelf structure includes a welded wire mesh grid including a grid front side, a grid back side, a grid left side and a grid right side. A grid length is defined between the left and right sides. A grid width is defined between the grid front and back sides. The grid back side is turned up to define a grid back wall. The grid includes a bottom layer of lengthwise extending grid wires and a top layer of widthwise extending grid wires. The top layer of wires defines a grid top support plane. A nose piece is attached to the grid adjacent the grid front side and extends along the grid length. The nose piece includes an upper flange extending under the grid front side. The upper flange includes a step rising to a forward nose upper surface substantially flush with the grid top support plane. The nose piece includes a nose front wall extending downward from the forward nose upper surface.

In another embodiment a shelf assembly is provided including a support frame including first and second forward extending cantilevered support arms. A shelf structure is supported on the support arms. The shelf structure includes a wire mesh grid defining an upper support plane for articles received on the shelf structure. The shelf structure further includes a forward nose piece having a top nose surface flush with and defining an extension of the upper support plane such that no protruding edge is presented by the nose piece to snag articles sliding on the upper support plane. The nose piece includes a downwardly recessed rear lip extending rearward under the wire mesh grid.

In either of the above embodiments the grid front side may be defined by free forward ends of the wires of the top layer of widthwise extending grid wires. The forward ends terminate adjacent the step of the upper flange of the nose piece.

In any of the above embodiments the step of the nose piece may rise at an angle of from 40° to 50° relative to the grid top support plane.

In any of the above embodiments the step of the nose piece may rise substantially perpendicular to the grid top support plane.

In any of the above embodiments the left and right grid sides may be defined by left and right outermost widthwise extending grid wires of the top layer. The nose piece upper flange may have left and right fastener apertures defined therethrough located lengthwise inward from the left and right grid sides, respectively, such that fastener heads of fasteners received through the apertures may be recessed below the grid top support plane.

In any of the above embodiments the nose piece may include a lower lip extending rearward from the front nose wall.

In any of the above embodiments the front nose wall may extend substantially vertically.

In any of the above embodiments the lower lip of the nose piece may extend substantially horizontally rearward.

In any of the above embodiments the front nose wall may have a curved widthwise cross-section, and the lower lip may be defined by a lowermost portion of the curved widthwise cross-section.

In any of the above embodiments the shelf structure may further include front and rear lengthwise extending flat plate reinforcing straps.

In any of the above embodiments the front reinforcing strap may be located between the nose piece and a forwardmost one of the lengthwise extending grid wires.

In another embodiment a method of manufacturing a shelf structure is provided. The method may include the steps of:

(a) placing in lengthwise orientation in a mesh welder:
  a bottom layer of lengthwise extending grid wires; and
  a nose piece located laterally outside the bottom layer of lengthwise extending grid wires, the nose piece including an upper flange located substantially coplanar with the bottom layer of lengthwise extending grid wires, the nose piece including a front wall extending downward from the upper flange, and the upper flange including a step rising up to a forward nose upper surface located higher than the bottom layer of lengthwise extending grid wires;

(b) sequentially placing in widthwise orientation a plurality of widthwise extending grid wires defining a top layer, each widthwise extending grid wire having a front end terminating adjacent the step of the nose piece, the top layer of widthwise extending grid wires defining a grid top support plane substantially flush with the forward nose upper surface; and (c) in turn welding each widthwise extending grid wire simultaneously to the lengthwise extending grid wires and the upper flange of the nose piece as the bottom layer of lengthwise extending grid wires and the nose piece advance through the mesh welder.

The method may further include in step (a) thereof placing in lengthwise orientation in the mesh welder front and rear lengthwise extending reinforcing straps.

The method may further include in step (a) locating the front reinforcing strap between the nose piece and a forwardmost one of the lengthwise extending grid wires of the bottom layer.

The method may further include in step (a) the locating of the rear reinforcing strap between two of the lengthwise extending grid wires of the bottom layer.

The method may further include in step (a) providing that the reinforcing straps are shorter than the lengthwise extending grid wires.

The method may further include after step (c), bending the widthwise extending wires of the top layer to form an upwardly extending rear wall.

Numerous objects, features and advantages of the present invention will be readily apparently to those skilled in the art upon a reading of the following disclosure when taken in conjunction with the accompanying drawings.

DETAILED DESCRIPTION

Figure 1:
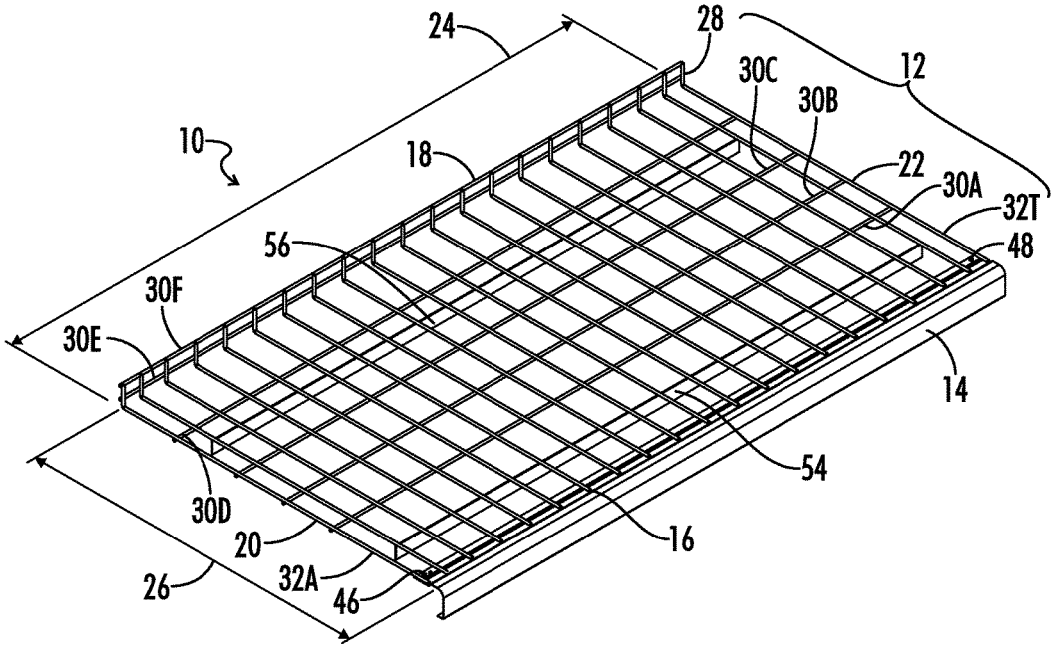
FIG. 1 is a perspective view of a first embodiment of a shelf structure.
Figure 2:
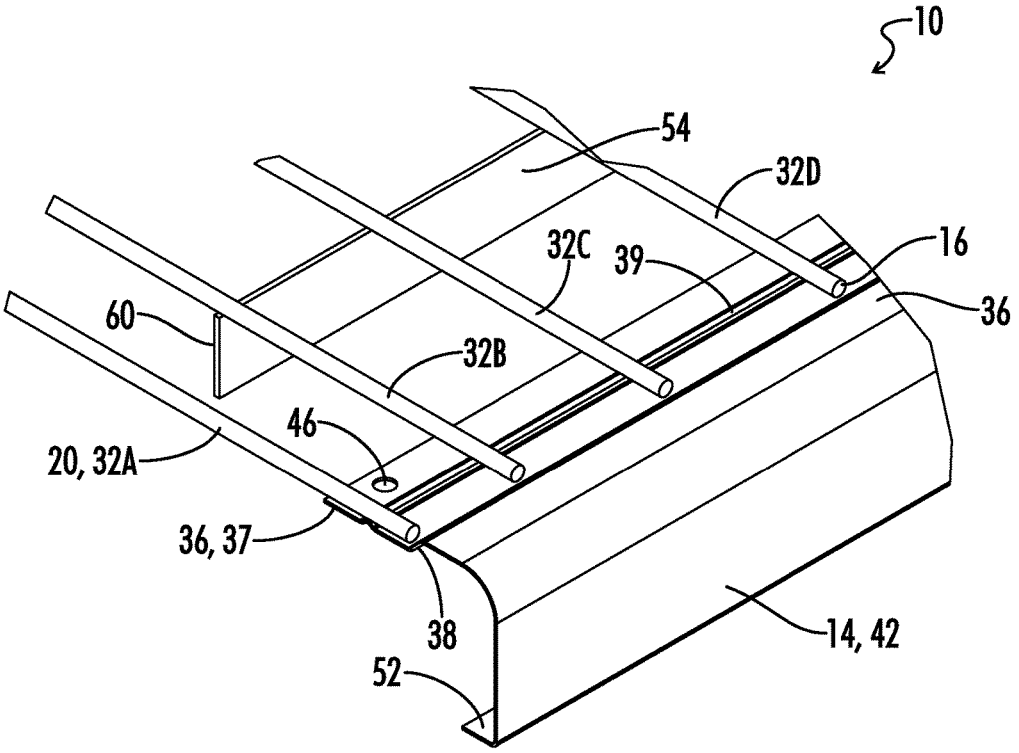
FIG. 2 is an enlarged view of the front left corner of the shelf structure of FIG. 1.
Figure 3:
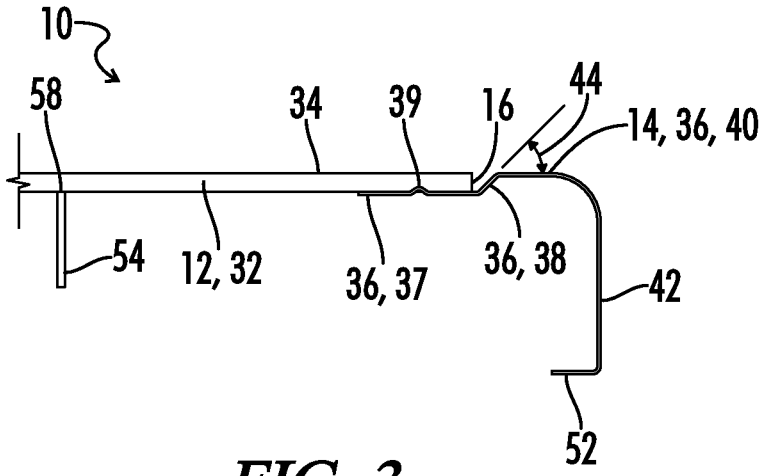
FIG. 3 is a left end elevation view of the front edge portion including the nose piece of the shelf structure of FIG. 1.

Referring now to the drawings and particularly to FIGS. 1-3, a shelf structure is shown and generally designated by the numeral 10. The shelf structure 10 includes a welded wire mesh grid 12 and a nose piece 14.

The welded wire mesh grid 12 includes a grid front side 16, a grid back side 18, a grid left side 20 and a grid right side 22. A grid length 24 is defined between the left and right sides 20 and 22. A grid width 26 is defined between the grid front and back sides 16 and 18.

The grid back side 18 is turned up to define a grid back wall or rear wall 28. The turned up rear wall 28 aids in preventing articles from sliding off the rear of the shelf structure 10, and also increases the structural moment of inertia which resists lengthwise bending of the shelf structure 10.

The grid 12 includes a bottom layer 30 of lengthwise extending grid wires 30A, 30B, 30C, 30D, 30E and 30F. The grid 12 further includes a top layer 32 of widthwise extending grid wires 32A-32T. The number of wires used in each layer may be varied. As is best shown in FIG. 3, the upper surfaces of the widthwise extending grid wires 32 define a grid top support plane or upper support plane 34 for supporting articles such as packages of clothing. The rear wall or back wall 28 extends upward above the support plane 34 of the shelf structure 10.

The nose piece 14 is attached to the grid 12 adjacent the grid front side 16 and extends along the grid length 24. The nose piece 14 includes an upper flange 36 having a downwardly recessed rear lip 37 extending rearward under the grid front side 16. The upper flange 36 includes a step 38 rising from rear lip 37 to a forward nose piece upper surface or top nose surface 40 which as seen in FIG. 3 is substantially flush with the grid top support plane 34. The nose piece 14 further includes a front nose wall 42 extending downward from the forward nose upper surface 40.

The forward nose piece upper surface 40 is flush with and defines an extension of the upper support plane 34 such that no protruding edge is presented by the nose piece 14 to snag articles sliding on the upper support plane 34.

The grid front side 16 is defined by free forward ends of the wires of the top layer 32 of widthwise extending grid wires. Those forward ends terminate adjacent the step 38 of the upper flange 36 of the nose piece 14.

As best seen in FIG. 3, in one embodiment the step 38 rises at an angle 44 relative to the grid top support plane 34. The angle 44 may be in a range of from 40° to 50°, and preferably is about 45°.

Figure 3A:
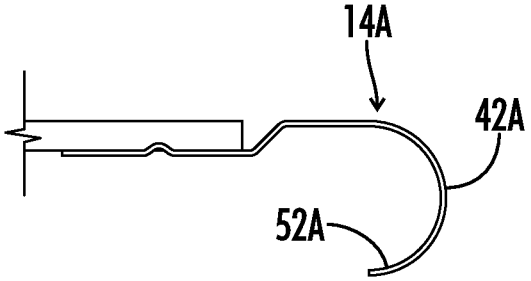
FIG. 3A is a view similar to FIG. 3 showing an alternative construction for the nose piece having a curved front wall as opposed to the vertical front wall of FIG. 3.
Figure 3B:
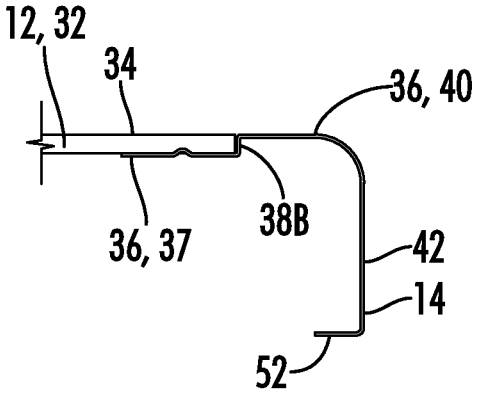
FIG. 3B is a view similar to FIG. 3 showing an alternative construction for the nose piece having a perpendicular step.

An alternative embodiment for the step is shown in FIG. 3B, and is identified as step 38B. The step 38B rises substantially perpendicularly to the grid top support plane 34. The perpendicular step 38B may also be used with a curved front wall like that shown in FIG. 3A.

The left and right grid sides 20 and 22 are defined by left and right outermost widthwise grid wires 32A and 32T.

The nose piece upper flange 36 has left and right fastener apertures 46 and 48 defined therethrough located lengthwise inward from the left and right grid sides 20 and 22, respectively, such that fastener heads 51 (see FIG. 5) of fasteners 50 received through the apertures 46 and 48 may be recessed below the grid top support plane 34. Alternatively, the fastener heads 51 may be arranged so that their top surfaces are flush with the grid top support plane 34.

As best seen in FIGS. 2 and 3, the nose piece 14 includes a lower lip 52 extending rearward from the front nose wall 42. In the embodiment shown in FIGS. 1-3, the front nose wall 42 extends substantially vertically, and the lower lip 52 extends substantially horizontally rearward.

FIG. 3A is a view similar to FIG. 3 showing in cross-section view an alternative design for the nose piece which is designated as 14A. The alternative nose piece 14A has a front nose wall 42A that has a curved widthwise cross-section, and the lower lip 52A is defined by a lowermost portion of the curved widthwise cross-section.

The shelf structure 12 may also include one or more reinforcing straps such as front and rear lengthwise extending flat reinforcing straps 54 and 56. Each strap 54 and 56 is oriented vertically on edge. This is best seen in FIG. 3 where the front reinforcing strap 54 is shown in enlarged view. Each of the straps such as front reinforcing strap 54 has an upper edge 58 welded to a plurality of the widthwise extending grid wires of the top layer 32. In the embodiment shown in FIG. 1, each of the reinforcing straps 54 and 56 is welded to all of the widthwise extending grid wires except for the laterally outermost ones 32A and 32T. As also seen in FIGS. 1 and 2, each of the reinforcing straps 54 and 56 may have left and right ends, such as left end 60 of front reinforcing strap 54 seen in FIG. 2, which ends terminate short of the left and right grid sides, 20 and 22, respectively.

The front strap 54 may be located between the nose piece 34 and a forwardmost one 30A of the lengthwise extending grid wires. The rear reinforcing strap 56 may be located widthwise between lengthwise extending grid wires 30C and 30D. The locations of the straps may be varied.

Figure 4:
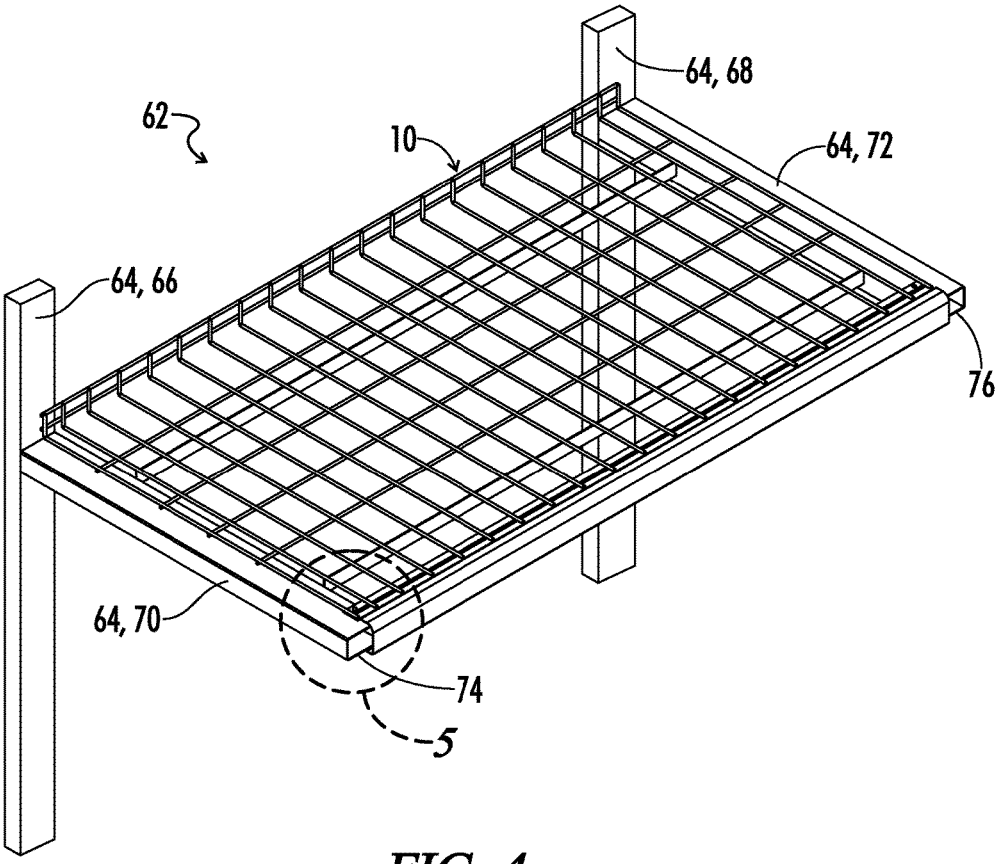
FIG. 4 is a perspective view illustrating the shelf structure of FIG. 1 in place on the cantilevered arms of a support frame of a shelf assembly.

FIG. 4 is a perspective view of a shelf assembly 62 which includes a support frame 64 made up of vertical support columns 66 and 68 and first and second forward extending cantilevered support arms 70 and 72. The shelf assembly 62 includes the shelf structure 10 as previously described, which is supported on the support arms 70 and 72.

Figure 5:
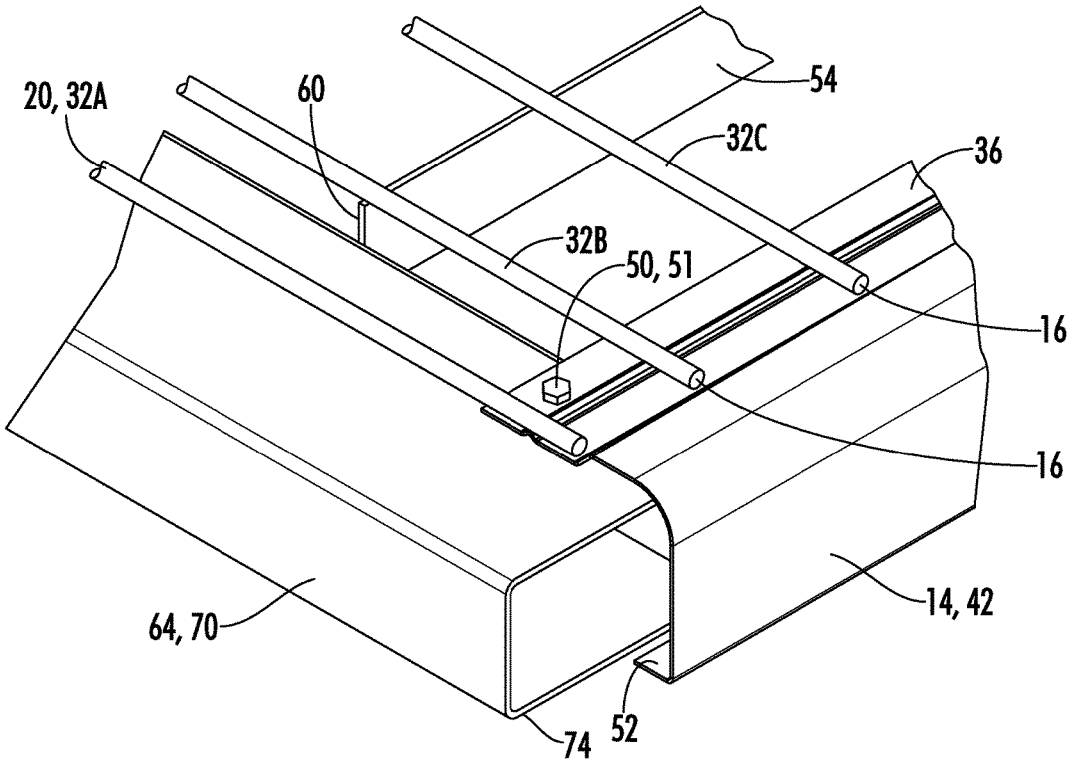
FIG. 5 is an enlarged view of the front left corner of the shelf assembly of FIG. 4 showing the placement of a hex head fastener which is flush with or recessed below the grid top support plane.

As best seen in FIGS. 4 and 5, the apertures 46 and 48 overlie the first and second support arms 70 and 72. Fasteners such as fastener 50 seen in FIG. 5 extend downward through the apertures 46 and 48 and fasten the shelf structure 12 to the first and second support arms 70 and 72, respectively. The fasteners 50 may be hex head sheet metal screws. The fasteners 50 each include a fastener head 51 lying below or flush with the upper support plane 34 such that articles sliding on the upper support plane do not snag on the fastener heads 51.

This design of shelf structure is particularly useful for apparel packaged in lightweight plastic bags. Such packages are relatively easy to snag and tear on any protruding surface. Thus the shelf structure 10 having a nose piece 14 designed so as to be free of any protruding edges and providing the ability to place the fastener heads 51 flush with or below the supporting surface 34 greatly reduces the incidence of damage to such packages.

As best seen in FIG. 5, the downwardly extending front wall 42 of nose piece 14 extends downward over front ends 74 and 76 of the support arms 70 and 72. Typically each support arm 70 and 72 will have two shelves 10 attached thereto side by side, and the nose pieces of the two shelves together will substantially cover the front ends 74 and 76.

The nose piece 14 provides several important functions to the shelf structure 10. First, the nose piece 14 structurally stiffens the shelf structure 10 providing an important structural component. Second, the nose piece 14 covers the forward ends 74 and 76 of the first and second cantilevered arms 70 and 72 so as to protect warehouse workers from striking the relatively sharp edges of the forward ends 74 and 76 of the support arms. Third, the front wall 42 of the nose piece 14 provides a surface for the attachment of labels or bar code stickers identifying the warehouse location and/or the contents of the packages placed upon the shelf in the warehouse.

Methods of Manufacture

Figure 6:
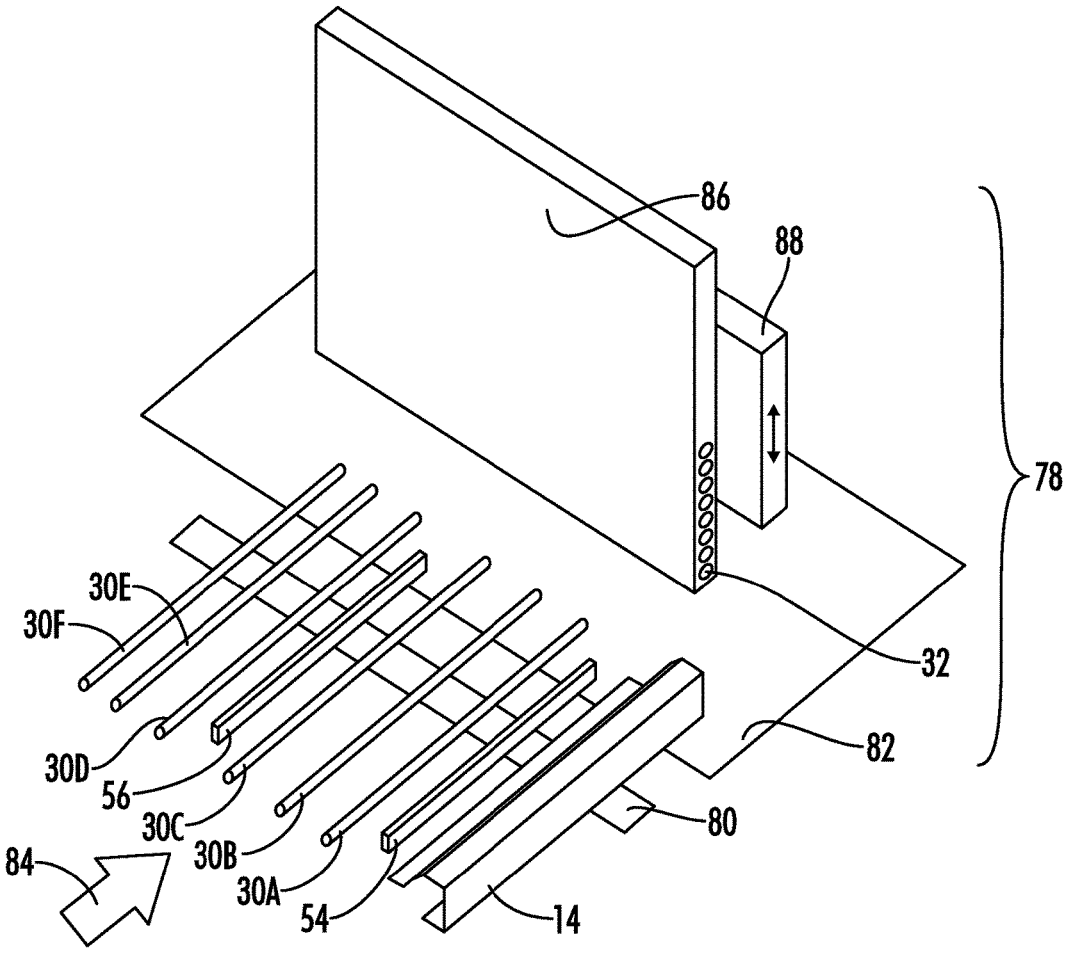
FIG. 6 is a schematic perspective view of the process of manufacturing the shelf structure of FIG. 1 showing the various lengthwise components being fed into a mesh welding machine, and illustrating the widthwise grid wires in a wire feeder. A resistance welding apparatus is shown which will index downward to weld the widthwise grid wires on top of the lengthwise components as the lengthwise components are indexed through the welding machine.

Referring now to FIG. 6, a method of manufacturing a shelf structure such as the shelf structure 10 of FIG. 1 is described.

The wire material for the wire components 30 and 32 will typically be provided in coiled form, and the wire will be straightened and cut to length for use in the shelf structure 10. The reinforcing straps such as 54 and 56 will be provided as straight lengths which will be cut to length for use in the shelf structure 10.

The nose piece 14 will be formed in long straight sections which will be cut to length and punched with holes 46 and 48.

The wire members 30 and 32 may be made of 6 GA steel wire. The reinforcing straps 54 and 56 may be made of 14 GA steel strap material. The nose piece 14 may be made of 20 GA steel sheet metal material. The shelf structure may have a shelf length 24 of approximately 48 inches, and a shelf width 26 of approximately 28 inches. The construction illustrated provides a shelf structure 10 having a weight of approximately 11.6 pounds. These materials in combination with the shelf structure of FIGS. 1-3 provide a very efficient use of material resulting in a lightweight, strong and economical shelf construction.

The components making up the shelf structure 10 are welded together by resistance welding in a conventional mesh welding machine schematically illustrated at 78 in FIG. 6. Such mesh welding machines are well known to those skilled in the art.

Figure 7:
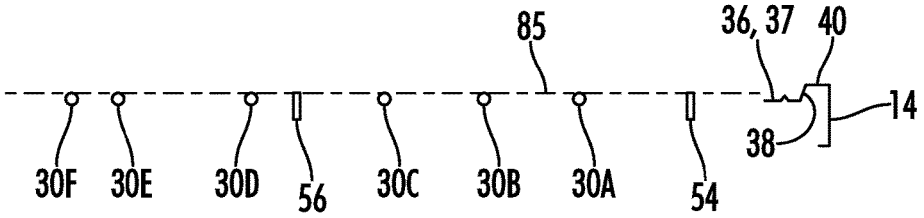
FIG. 7 is a schematic illustration of the orientation of the various lengthwise members as they are placed in a mesh welding machine of FIG. 6.
Figure 8:
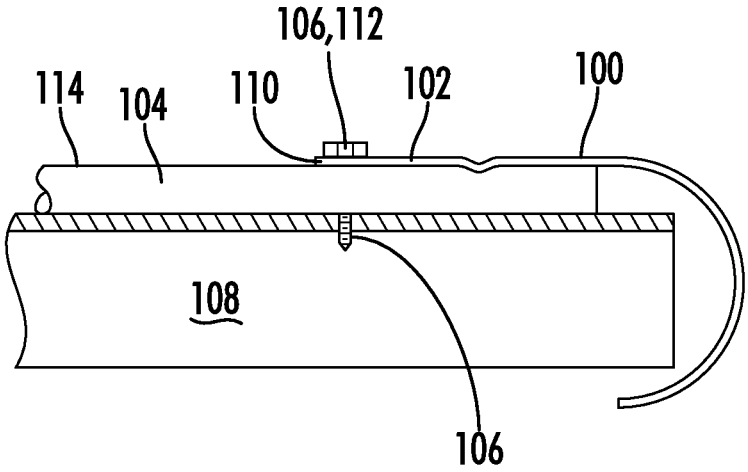
FIG. 8 (PRIOR ART)
FIG. 8 is a schematic side elevation view of a prior art shelf construction.

The bottom layer of lengthwise extending grid wires 30A-30F, the nose piece 14, and the front and rear reinforcing straps 54 and 56 are placed in lengthwise orientation as schematically illustrated in FIG. 6 within the mesh welder 78. A suitable jig or supporting structure 80 schematically illustrated in FIG. 6 supports those lengthwise components as they move forward into a welding station 82 in the direction of motion indicated by arrow 84. The support structure 80 supports the various lengthwise components such that the rear lip portion 37 of the upper flange 36 of the nose piece 14 has its upper surface oriented substantially co-planar with plane 85 defined by the upper edges of the lengthwise extending grid wires 30A-30F and the lengthwise extending reinforcing straps 54 and 56 as schematically illustrated in FIG. 7. There it is seen that the upper flange 36 of nose piece 14 includes the step 38 rising up to the nose forward upper surface 40 located higher than the plane 85 of the bottom layer of lengthwise extending grid wires 30A-30F. The rearward extending lip portion 37 of the nose piece 14 has a ridge 39 formed thereon which forms a point of welding contact with the widthwise extending wire members 32.

The lengthwise extending members are then indexed forward in direction 84 through the mesh welder 78 in stepwise fashion.

The mesh welder 78 includes a wire loader 86 which has a plurality of the widthwise extending wire members 32 located therein. Behind the wire loader 86 is a resistance welding apparatus schematically illustrated at 88.

The lengthwise members are moved forward to a position in the welding station 82 at which their motion stops. Then one of the widthwise wire members 32 is placed across the lengthwise wire members. When the widthwise extending wire members 32 are placed on top of the lengthwise extending members, they are oriented substantially as seen in FIG. 3 wherein each widthwise extending grid wire 32 has its front end terminating adjacent the step 38 of the nose piece 14, such that the top layer of widthwise extending grid wires 32 define the grid top support plane 34 substantially flush with the forward nose upper surface 40.

Then the welding apparatus 88 engages the widthwise wire member 32 pressing it downward on top of the lengthwise wire members and applying an electric current therethrough to create resistance welds between the widthwise wire member 32 and the various lengthwise members laying thereunder. Then the welding apparatus 88 moves upward, the lengthwise members index forward by a distance equal to the spacing desired between the widthwise wire members 32, then another widthwise wire member 32 is deposited and welded in place. The process repeats until all of the widthwise wire members 32 have been welded on top of the lengthwise members. Then the welded structure is moved forward to a bending machine (not shown) wherein the widthwise wire members are bent to form the upward extending wall 28 seen in FIG. 1.

Thus it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art upon a reading of the following disclosure when taken in conjunction with the accompanying drawings.

What is claimed is:

1. A shelf structure, comprising:

a welded wire mesh grid including a grid front side, a grid back side, a grid left side and a grid right side, a grid length defined between the left and right sides, a grid width defined between the grid front and back sides, the grid back side being turned up to define a grid back wall, the grid including a bottom layer of lengthwise extending grid wires and a top layer of widthwise extending grid wires defining a grid top support plane; and a nose piece formed of sheet metal, the nose piece attached to the grid adjacent the grid front side and extending along the entire grid length from the grid left side to the grid right side in front of a plurality of the widthwise extending grid wires, the nose piece including an upper flange, the upper flange including a rearward extending lip portion spanning the entire grid length from the grid left side to the grid right side under the grid front side and welded to each of the widthwise extending grid wires, the upper flange further including a step rising upwardly to a forward nose upper surface above the bottom layer of lengthwise extending grid wires and substantially flush with the grid top support plane of the top layer of widthwise extending grid wires, the nose piece including a front nose wall extending downward from the forward nose upper surface.

2. The shelf structure of claim 1, wherein:

the grid front side is defined by free forward ends of the wires of the top layer of widthwise extending grid wires, the forward ends terminating adjacent the step of the upper flange of the nose piece.

3. The shelf structure of claim 1, wherein:

the step rises substantially perpendicular to the grid top support plane.

4. The shelf structure of claim 1, wherein:

the left and right grid sides are defined by left and right outermost widthwise extending grid wires of the top layer; and the nose piece upper flange has left and right fastener apertures defined therethrough located lengthwise inward from the left and right grid sides, respectively, such that when fasteners are received through the apertures, fastener heads of the fasteners are recessed below the grid top support plane.

5. The shelf structure of claim 1, wherein:

the nose piece includes a lower lip extending rearward from the front nose wall.

6. The shelf structure of claim 5, wherein:

the front nose wall extends substantially vertically.

7. The shelf structure of claim 6, wherein:

the lower lip extends substantially horizontally rearward.

8. The shelf structure of claim 5, wherein:

the front nose wall has a curved widthwise cross-section, and the lower lip is defined by a lowermost portion of the curved widthwise cross-section.

9. A shelf structure comprising:

a welded wire mesh grid including a grid front side, a grid back side, a grid left side and a grid right side, a grid length defined between the left and right sides, a grid width defined between the grid front and back sides, the grid back side being turned up to define a grid back wall, the grid including a bottom layer of lengthwise extending grid wires and a top layer of widthwise extending grid wires defining a grid top support plane;

a nose piece attached to the grid adjacent the grid front side and extending along the grid length, the nose piece including an upper flange extending under the grid front side, the upper flange including a step rising to a forward nose upper surface substantially flush with the grid top support plane, the nose piece including a front nose wall extending downward from the forward nose upper surface; and at least one lengthwise extending flat plate reinforcing strap oriented vertically on edge and having an upper edge welded to a plurality of the widthwise extending grid wires of the top layer, the strap having left and right ends terminating short of the left and right grid sides.

10. The shelf structure of claim 9, wherein:

the strap is located between the nose piece and a forwardmost one of the lengthwise extending grid wires.

* * * * *